US011565160B2

(12) United States Patent
Keyhani

(10) Patent No.: US 11,565,160 B2
(45) Date of Patent: Jan. 31, 2023

(54) BASKETBALL DRIBBLING TRAINING PAD

(71) Applicant: Garret S. E. Keyhani, Hillsborough, CA (US)

(72) Inventor: Garret S. E. Keyhani, Hillsborough, CA (US)

( * ) Notice: Subject to any disclaimer, the term of this patent is extended or adjusted under 35 U.S.C. 154(b) by 257 days.

(21) Appl. No.: 17/033,327

(22) Filed: Sep. 25, 2020

(65) Prior Publication Data

US 2022/0096911 A1 Mar. 31, 2022

(51) Int. Cl.
*A63B 69/00* (2006.01)
*A63B 71/06* (2006.01)

(52) U.S. Cl.
CPC ..... *A63B 69/0071* (2013.01); *A63B 71/0622* (2013.01); *A63B 2071/0647* (2013.01); *A63B 2220/20* (2013.01); *A63B 2220/30* (2013.01); *A63B 2220/53* (2013.01); *A63B 2220/833* (2013.01); *A63B 2225/093* (2013.01); *A63B 2225/50* (2013.01); *A63B 2243/0037* (2013.01)

(58) Field of Classification Search
CPC ..... A63B 69/0071; A63B 71/0622; A63B 2071/0647; A63B 2220/20; A63B 2220/30; A63B 2220/53; A63B 2220/833; A63B 2225/093; A63B 2225/50; A63B 2243/0037
See application file for complete search history.

(56) References Cited

U.S. PATENT DOCUMENTS

2011/0304497 A1* 12/2011 Molyneux ..... G01S 13/751 342/42
2012/0029666 A1* 2/2012 Crowley ..... A61B 5/6895 700/91
2018/0200602 A1* 7/2018 Simón Vilar ..... G06V 20/42

* cited by examiner

*Primary Examiner* — Jeffrey S Vanderveen
(74) *Attorney, Agent, or Firm* — Squire Patton Boggs (US) LLP

(57) ABSTRACT

A basketball dribbling pad is provided to provide dribbling feedback to a user or a coach. The basketball dribbling pad can measure dribble speed, dribble force, and/or dribble height and provide live feedback to a computer or a mobile device. The computer or mobile device can also store the history so that progress of the athlete can be monitored.

18 Claims, 5 Drawing Sheets

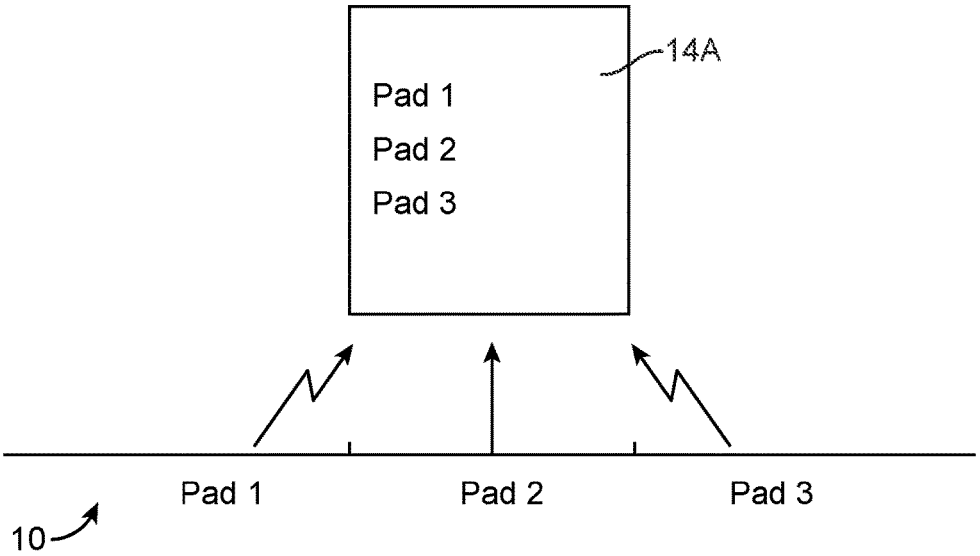
FIG. 7A
14A
| User | Avg. Speed | Avg. Force |
|---|---|---|
| Garret | | |
| Cal | | |
| Zay | | |
| Harlan | | |
FIG. 7B
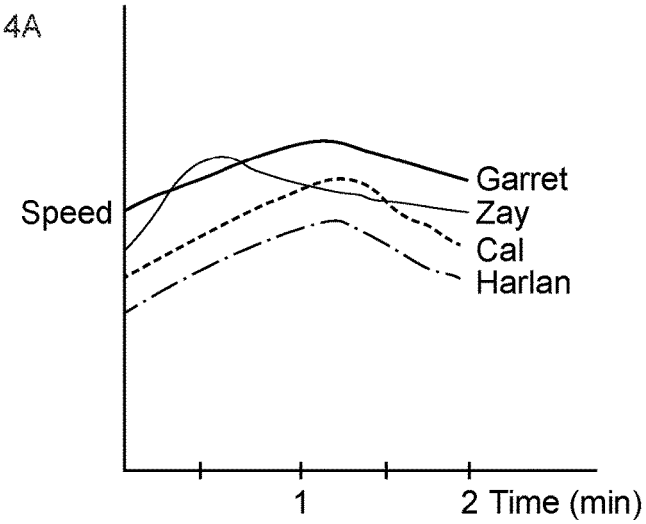
FIG. 7C

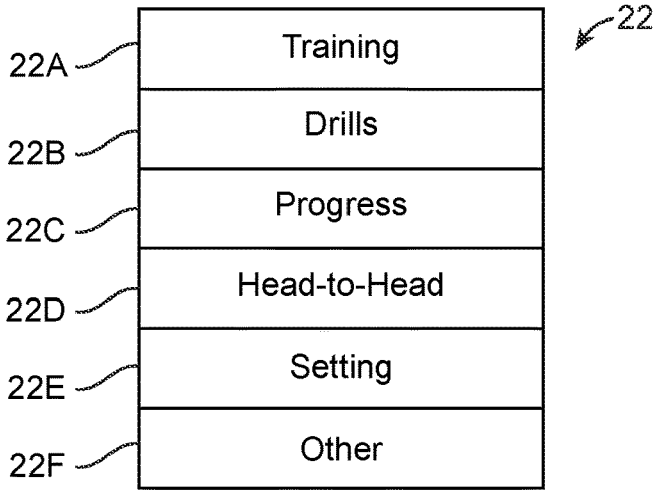
FIG. 8A
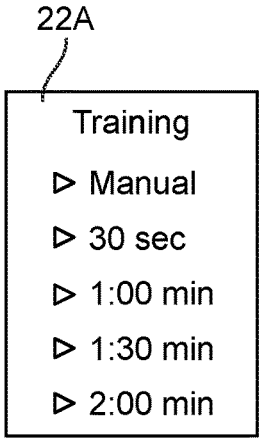
FIG. 8B1
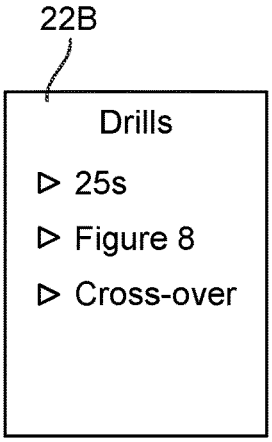
FIG. 8C1
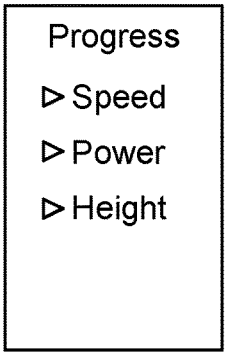
FIG. 8D1
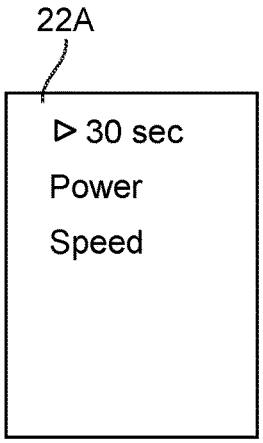
FIG. 8B2
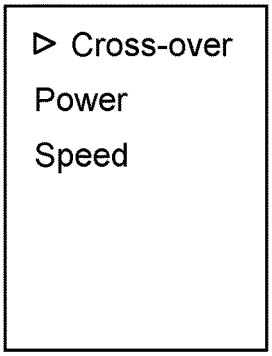
FIG. 8C2
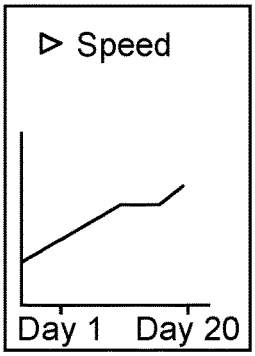
FIG. 8D2

BASKETBALL DRIBBLING TRAINING PAD

FIELD OF INVENTION

This invention relates to a sports training pad. More specifically, the invention relates to a basketball dribbling training pad that allows an athlete to get more proficient and skilled in his or her dribbling prowess.

BACKGROUND

Most basketball players concentrate on shooting (and layups) during practices. Feedback on shooting is simple. The player and coach can observe the arc of the ball, rotation of the ball, release mechanics, and how many shots are made. Dribbling is equally an integral part of the game. As basketball training is becoming more sophisticated, coaches are spending a greater amount of time training the athletes in proper dribbling techniques, such as looking up when dribbling the ball, ambidexterity, dribble speed, dribble force, and the proper height of the dribble (i.e., the downward distance traveled by the ball from the athlete's hand to the floor). By way of example, drills where two (2) balls are dribbled simultaneously by both the dominant hand and the weak hand, either in synchronicity or alternating pattern is being implemented in all practices. Indeed, all-star point guard Steph Curry employs a 2-ball dribble routine in his pregame, warm-up ritual. Dribbling the ball in a figure-8 pattern between the legs is also a common basketball drill. It is critical to have the same dribble speed, force, and height for the weak hand as compared to the strong hand. However, coaches and players cannot monitor dribble speed, force, and height during practices to see whether the strong hand is improving and to see if the weak hand is as proficient, or is becoming as proficient, as the dominant hand. Additionally, it would be useful to provide the athlete with feedback as to what areas need improvement.

The embodiments of the present invention provide a basketball dribbling system and method of use that allows users to improve their dribbling and for coaches to monitor the progress of the athletes. The invention also provides critical feedback to the athlete on what aspects of dribbling to improve upon.

SUMMARY

A basketball dribbling pad is provided comprising a pad configured to allow a user to dribble at least one basketball on the pad. A sensor is integrated with the pad for detecting at least one dribbling characteristic. A controller is in communication with the sensor. The controller is configured to convert the at least one dribbling characteristic into at least one dribbling feedback. The at least one dribbling characteristic can be dribble speed, dribble force, dribble height, or a combination of any of dribble speed, dribble force, and dribble height. The at least one dribbling feedback can be a dribble speed for each dribble; a predicted average dribble speed for a duration of a selected drill; an actual average dribble speed for a duration of the selected drill; or any combination of these. The controller is configured to store the dribbling feedback of more than one selected drill. The controller is configured to provide a comparison of the dribbling feedback for selected drills performed. The comparison can be shown on a monitor in form of a line or bar graph, such that the vertical axis includes the actual average dribble speed and the horizontal axis includes the selected drills performed (e.g., by date and/or time).

In some embodiments, in combination with any of the embodiments disclosed herein, the least one dribbling feedback can be a unit force for each dribble; a predicted average unit force for the duration of a selected drill; actual average unit force for the duration of the selected drill; or any combination of these. The controller is configured to store the dribbling feedback of more than one selected drill. The controller is configured to provide a comparison of the dribbling feedback for selected drills performed. The comparison can be shown on a monitor in form of a line or bar graph, such that the vertical axis includes the actual average unit force and the horizontal axis includes the selected drills performed (e.g., by date and/or time).

In some embodiments, in combination with any of the embodiments disclosed herein, the dribbling feedback can be unit height for each dribble (i.e., the downward distance that the ball travers from a user's hand to the pad); a predicted average dribble height for the duration of the a selected drill; an actual average dribble height for the duration of the drill; or any combination of these. The controller is configured to store the dribbling feedback of more than one selected drill. The controller is configured to provide a comparison of the dribbling feedback for selected drills performed. The comparison can be shown on a monitor in form of a line or bar graph, such that the vertical axis includes the actual average dribble height and the horizontal axis includes the selected drills performed (e.g., by date and/or time).

The controller can provide live feedback view of the least one dribbling feedback to the user or a coach on a monitor as the user is performing a dribbling drill. The height of the monitor is adjustable to accommodate basketball players of different tallness. In some embodiments, the monitor is adapted to be removably connected to the pad. In some embodiments, the monitor is in wireless communication with the pad. The controller and can be a computer (e.g., pc), smart phone, or a tablet.

In some embodiments, the pad comprising at least two dribbling zones such that each dribbling zone includes a sensor for detecting dribbling characteristics associated with their respective zone.

In some embodiments, the pad comprises two dribbling zones, a first zone designated for dribbling of a first ball with a right hand and a second zone designated for dribbling a second ball with the left hand, such that the sensor(s) of the first zone detect a first dribbling characteristic(s) and the sensor(s) of the second zone detect a second dribbling characteristic(s). The controller converts the dribbling characteristics into dribbling feedback for display on a monitor and can store the same.

The sensor of the pad can be configured to communicate with a mobile device (e.g., iPhone) or a tablet (e.g., iPad), such that the mobile device or tablet:

(a) is configured to provide designated drills for the user or multiple users to perform;

(b) is configured to provide live view of the at least one dribbling feedback to the user(s) or a coach while the user(s) is/are dribbling at least one ball on the pad;

(c) is configured to provide history of the at least one dribbling feedback performed by any number of users for any of the drills performed;

(d) is configured to provide comparison of the at least one dribbling feedback for drills performed by any number of users; or (e) any combination of (a)-(d).

BRIEF DESCRIPTION OF THE DRAWINGS

FIG. 7A is an embodiment of the basketball training pad illustrating multiple pads (e.g., arranged in series—the pad can be connected or separate) in communication with a feedback device, such as a mobile device (e.g., iPhone) or a tablet (e.g., iPad);

FIG. 7B is an example of a display for the head-to-head competition, showing the average speed and average force for a drill for each user;

FIG. 7C is an example of a display for the head-to-head competition, showing a graph of each user's performance; and FIG. 8A-8D2 illustrates the display of a controller that can communicate with a basketball training pad for displaying menus such as training, drills, progress, head-to-head competition, setting, and other.

DETAIL DESCRIPTION OF THE EMBODIMENTS OF THE INVENTIONS

Singular term as used herein is intended to include the plural form, and vise-versa, unless an unambiguous disclaimer is provided that the term is intended to be singular or plural. For example, "sensor," "sensors" or "sensor(s)" is intended to encompass both the singular or plural forms of the word unless specifically stated otherwise, such as "one sensor," "two sensors," or "multiple sensors." As an added example, "user," "users" or "user(s)" is intended to include any number of users unless specifically stated otherwise, such as "single user" or "multiple users." As a third example, the word "ball" can mean a single ball or more than one ball unless the number is specifically made clear, e.g., "single ball" or "two balls."

Figure 1:
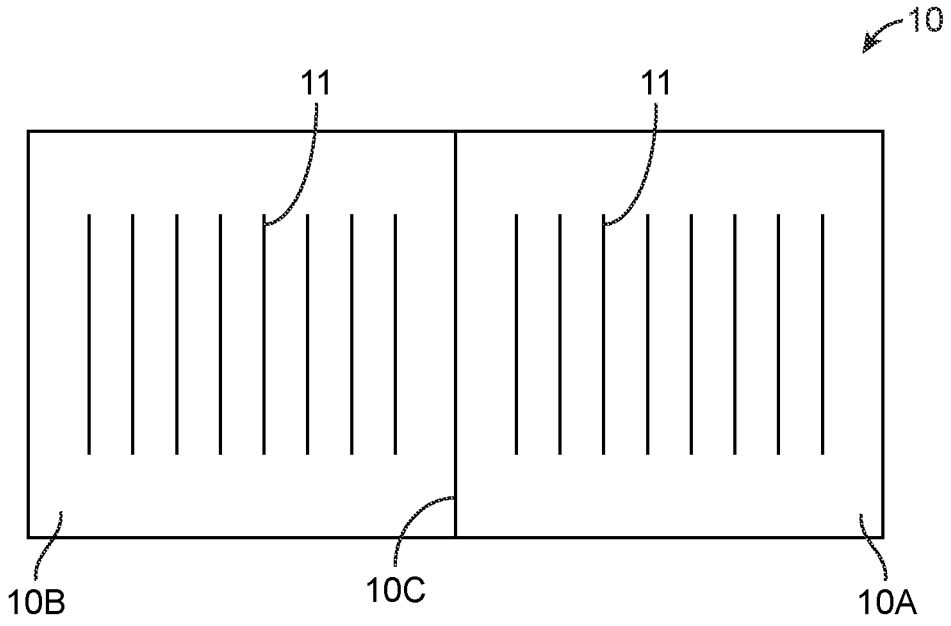
FIG. 1 is an embodiment of a basketball training pad.

Referring now to the figures, FIG. 1 illustrates one embodiment of a basketball dribbling pad 10 of the present invention. The dribbling pad 10 is sized for allowing a user to either stand on the pad 10, or on or in proximity to the edge of the pad 10 for dribbling one or multiple basketballs. One or multiple sensor(s) 11 are integrated with the pad 10—for example sandwiched between two layers of the pad 10 or placed within a single pad layer. As an illustrative example, the sensors 11 are illustrated as line or strip sensors 11. The sensor(s) 11 can be of the type that upon contact will generate a signal so that the time interval between each contact can be determined and/or the amount of pressure/force applied to the sensors can be measured. The pad 10 can include one zone or multiple dribbling zones such as two dribbling zones 10A and 10B. Each zone 10A and 10B includes corresponding sensor 11 or corresponding group of sensors 11 for detecting dribbling characteristic(s) for their respective zone. The dribbling characteristic(s) are then converted by a controller to dribbling feedback for illustration to a user or a coach on a monitor. In one preferred embodiment, the dribbling characteristics detected by the sensor includes one or a combination of dribble speed, dribble pressure/force, and dribble height (i.e., the approximate distance that the ball travels from a user's hand to the pad 10 per dribble). A clear line or boarder 10C can be provided as a visual marker for the user to allow the user to distinguish between the boundaries of the two zones 10A and 10B. The boarder 10C can be sensor-free, e.g., within 2 to 8 inches on each left and right side of the line 10C, so as to avoid taking a measurement of the dribbling characteristic in case the user inadvertently dribbles the ball on or close to the boarder 10C. In this embodiment, the user's left leg can be on one side of the line 10C and the right leg on the other side of the line 10C—squatted and in an ideal dribbling stance.

Figure 2:
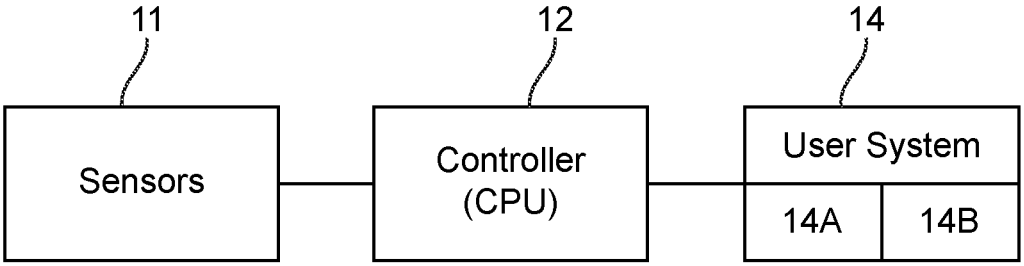
FIG. 2 is an embodiment of a system of the preset invention.

As illustrated in FIG. 2, the sensors 11 of the pad 10 are in communication with a controller 12 (e.g., CPU) and provide signal to the controller 12. The controller 12 coverts the signal into dribbling feedback data. A user system 14, which includes a feedback device 14A (e.g., display panel), can be part of (e.g., same as) or in communication with the controller 12 and can display the dribbling feedback for the user or coach to see. The controller 12 and user system 14 can include a computer, a basic standing monitor, a desktop, a laptop, or preferably a mobile device such as a smart phone or a tablet. The signals from the sensors 11 are converted by the controller 12 into data or information about the dribbling characteristics of a user. The dribbling feedback preferably includes any one, all, or combination of:

(1) dribble or ball speed per dribble;
(2) a predicted average dribble or ball speed for a duration of time (e.g., a duration of a selected drill);
(3) an actual average dribble or ball speed for a duration of time (e.g., a duration of a selected drill);
(4) dribble pressure/force per dribble (e.g., in Newton, lbs, psi, Pa);
(5) a predicted average dribble pressure/force (e.g., in Newton, lbs, psi, Pa) for a duration of time (e.g., a duration of a selected drill);
(6) an actual average dribble pressure/force (e.g., in Newton, lbs, psi, Pa) for a duration of time (e.g., a duration of a selected drill);
(7) dribble height per dribble;
(8) a predicted average dribble height for a duration of time (e.g., a duration of a selected drill); and
(9) an actual average dribble height for a duration of time (e.g., a duration of a selected drill).

The duration of the selected drill can be selected manually or otherwise the use can selected a preset time (e.g., 30 seconds, 1 minute, 90 seconds, or 2 minutes). For the dribble height, it is preferred that information about the user is first inputted (e.g., via keyboard or touch pad 14B) to the controller 12, such as the height of the user, so that the signal can be converted into the data with a high degree of accuracy. The controller 12 can be preprogramed with a set of heights and the approximate position of a hand to the pad based on a height. Accordingly, when the user inputs his or her height, the controller matches that height with the approximate distance of the hand to the pad.

The feedback device 14A can display the dribbling feedback values, as recited above, live to a user or a coach. For example, every time the user dribbles the ball, the feedback device 14A can display the dribble force of the dominant hand, the weak hand, or the combination of both hands. During the dribbling of the ball(s), the feedback device 14A can also display how fast the ball(s) are being dribbled and/or the distance that the ball is traveling off the dribbling hand. The illustrations on the feedback device 14A can include one numerical value at a time, e.g., the speed, force, and/or height for each dribble consecutively flashed on the screen, one at a time. In one embodiment, the illustration can include a running numerical listing, e.g., a continuous list of speed, force, and/or height for each dribble until the drill is completed so that the user can see a running list of the dribbling feedback. This latter form can be useful to see at what point exhaustion sets in so that the user can aim to increase his or her endurance. The display can also show the predicted average value for the speed, force, and/or height when the drill is in progress so that the user would be motivated to pick up his or her intensity. After the completion of the drill, the display can show the actual average value for the speed, force, and/or height for the duration of the drill (e.g., 30 seconds to 2 minutes).

Instead of flashing or posting the numerical values, a graph can be used such that the vertical axis is the speed, force and/or height and the horizontal axis is dribble number ($1^{st}$ dribble, $2^{nd}$ dribble, $n^{th}$ dribble . . . ). The graph can be a line graph or a bar graph and each characteristic can be color coded so that the user or the coach can easily discern it. The user can certainly select the option of the format. The characteristics can be displayed in any preselected units of measurement, order, or format.

Figure 3A:
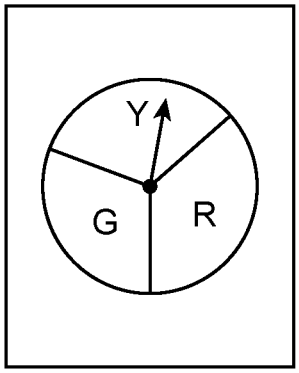
FIGS. 3A and 3B shows an embodiment of a graphical display.
Figure 3B:
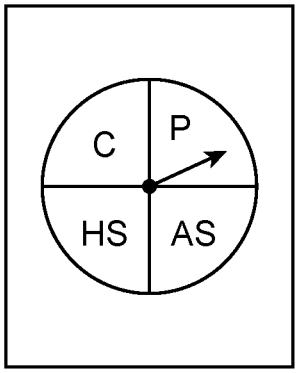

In some embodiments, the dribbling feedback can be displayed in a generic numerical scale, such as a scale of 1-10, wherein 1 is the worst (e.g., slow dribbling and softest dribbles) and 10 is the best (e.g., fastest dribbling and strongest dribbles). Referring to FIGS. 3A and 3B, in the graphic dial format, the display can resemble a speedometer. In one embodiment, colors can be used, for example, green section (G) depicting lowest value; yellow section (Y) depicting intermediate value, and red section (R) depicting highest value. The characteristics can also be displayed in order of "High School," "College," "Professional," and "All Star."

The feedback device 14A can be configured to provide feedback of both the dominant hand and the weak hand. The feedback device 14A can also provide, via the controller 12, the average speed, average force, and/or average height for each individual set of exercises being performed. The feedback device 14A can provide a comparison, such as in a graph format, in the difference between the performances of the dominant hand versus the weak hand. The controller 12 can store the dribbling characteristics data and provide feedback at a later time, when requested by the user. The controller 12 can further store the dribbling characteristic data and provide a history of the data to the user, such as by a bar or line graph. The time frame of the history can be selected by the user, e.g., total history, by month, by week, by selected times, or by a selected time fame. By way of example, the graph will have on the vertical axis average dribble speed and on the horizontal axis the time frame or dates selected by the user.

This way the athlete can keep abreast of his or her progress and look for areas that need improvement. The graph can include both the history of the dominant had and the weak hand in, for example, different colors. Similarly, another graph or the same graph, but with a different colors, can provide history of average dribble force (and/or dribble height) versus time frame or dates. This way, the coach or a user can see if any improvements have been made.

Figure 4:
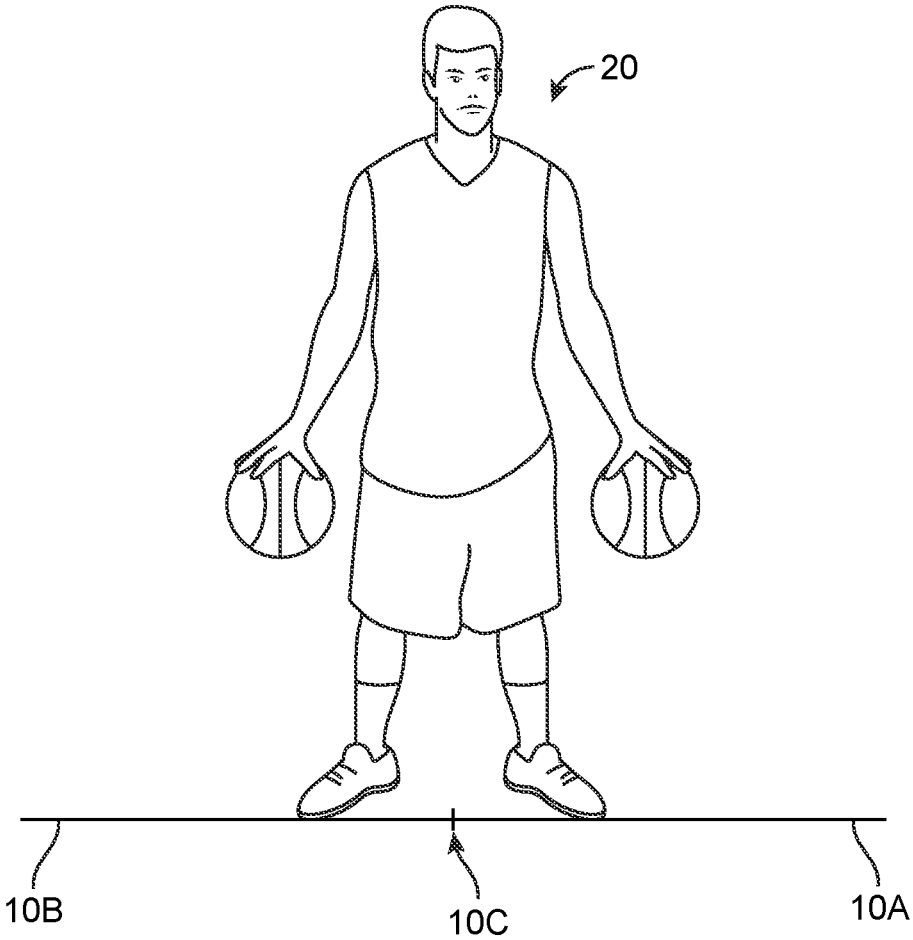
FIG. 4 is an embodiment of the basketball training pad, illustrating a user dribbling two balls on the pad.

FIG. 4 illustrates the user or athlete 20 on the pad 10 performing a 2 ball dribbling drill. The sensor system in zone 10B will detect dribbling characteristics or performance of the right hand, while the sensor system in zone 10A can simultaneously detect the dribbling characteristics of the left hand. As noted above, an area along boarder 10C can be sensor free and considered "out of bounds." Accordingly, any ball dribbled in zone 10C will not be recorded during the drill. Again, the signals from the sensor 11 are outputted to a controller 12 which converts the signals into data which are then displayed by the feedback device 14A for simultaneous input to the user or post-drill analysis.

Figure 5:
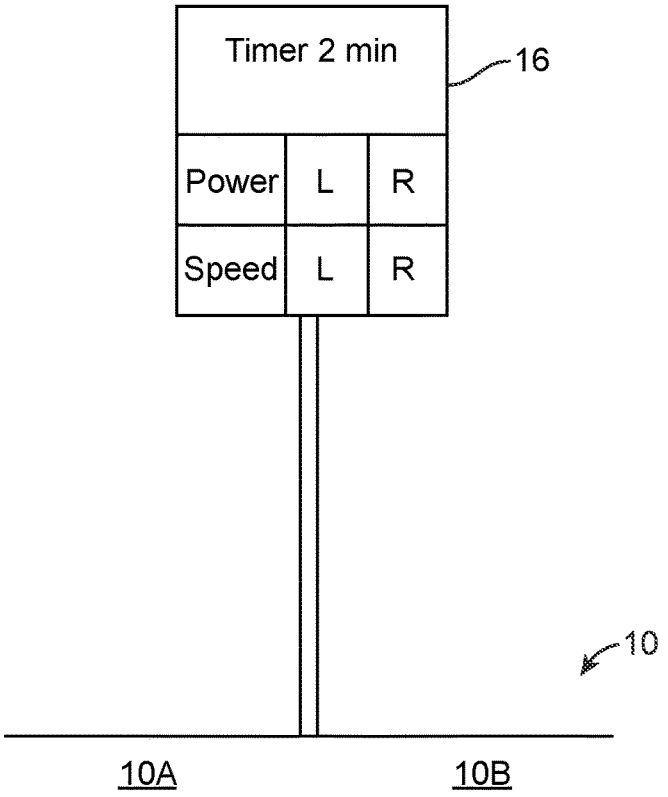
FIG. 5 is an embodiment of the basketball training pad having a feedback device (e.g., monitor) physically coupled to the pad.

FIG. 5 illustrates a basic monitor 16 as the feedback device 14A that is physically connected to the pad 10. The monitor 16 can be permanently connected or removable for easier storage. The monitor 16 can also serve, or instead act, as a docking station for a smart phone or a tablet such that data can be easily transferred to the phone or tablet or that the graphics can be shown via the phone or tablet. The height of the monitor 16 can be adjustable to accommodate children as well as adults of all sizes. This also allows the user to keep eye contact with the monitor 16 and not look down when dribbling. A single monitor 16 can display the data received from both dribbling zoned 10A and 10B. The single monitor 16 can have multiple display zones so that the user can clearly distinguish between right hand (R) and left hand data (L) or other drill information (e.g., timer) and data characteristics.

Figure 6:
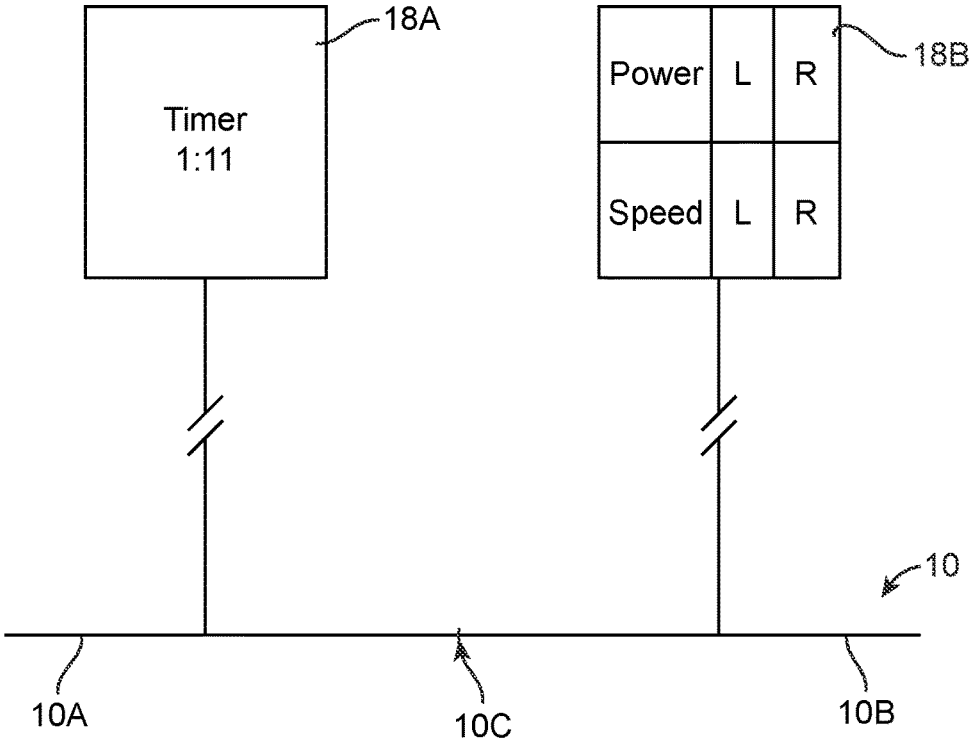
FIG. 6 is an embodiment of the basketball training pad having 2 feedback devices in communication with the pad.

FIG. 6 illustrates the dribbling pad 10 of the embodiment of the present invention but with two feedback devices 18A and 18B, which can be the same as monitor 16. Feedback device 18A can be in communication with zone 10A and feedback device 18B can be in communication with zone 10B. Each feedback system 18A and 18B can work independently or both 18A and 18B can be linked to each other and display any of the dribbling characteristics and drill information according to the user's visual preferences. For example, feedback system 18B can illustrate dribble speed and force for each of zones 10A and 10B while, simultaneously, feedback system 18A can show a drill clock (e.g., count down timer).

In some embodiments of the invention more than one pad 10 can be used in serial conjunction with one another for multiple user to train at the same time. FIG. 7A illustrate three pads 10—labeled as Pad 1, Pad 2 and Pad 3. All pads can be linked to a single controller 12 and user system 14, such as a computer, monitor, smart phone or tablet; or each pad can have its own designated controller and user system. In this embodiment, multiple users can engage in head-to-head competition with each other. A display of the feedback device 14A can show the dribble feedback for each user. The computer can also rank the users during the drill exercise. For example, for a two minute dribbling competition, the controller can rank the players in order of performance during the exercise. If the ranking is changing during the exercise, in that one user starts to outperform the other as the drill time progresses, the feedback device 14A can display the change in ranking as it happens. The feedback system 14A can also show the performance of each player after the end of the exercise and provide a comparison of each user's performance (for example in a line graph with each player has a different colored line). The controller 12 can also rank each player based on average speed, average force, and/or average distance at the end of the competition. FIG. 7B shows an exemplary display of ranking of the player based on averages after the exercise is over. FIG. 7C shows an exemplary display of a graph showing the performance of each player (e.g., speed) based on the time of the drill (e.g., 2 minutes). A comparison of the history for each player can also be made. For example, FIG. 7C can be the average speed (or force or height) for each player in the vertical axis and the selected drills performed in the horizontal axis. The graph can be color coded so that each player can be easily distinguished.

FIGS. 8A-8D illustrate the user input menus, which can be displayed on a feedback device 22 (e.g., user system 14—computer, monitor, smart phone or tablet), for an athlete to use to initiate the exercise with the pad 10. This feedback device 22 and menu can be implemented in all embodiments disclosed herein. As a preliminary matter, the user can go to "setting" 22E to input his or her user information, such as, for example, photo, age, and height. The data for height can be used to calculate the average distance from the user's hand to the pad 10 when the user is in a generally squatted, dribbling position. The average distance can be based on average distances already measured and stored in the controller. The controller 12 can match the user's height (e.g., 6'7") to a stored distance (e.g., 2'6") preselected for that height.

The first item in the menu can be labeled as "Training" 22A—although the order of the display of these menus is not important to this invention. The user 20 can select the training menu 22A and select the type of training that he or she desires. The type of training can include any time interval, as illustrated by FIG. 8B1. A duration of time can be inputted or the user can select from one of the preset times (e.g., 30 second, 1 minutes, 90 seconds, or 2 minutes). By way of example, the user can select a 30-second interval, as illustrated in FIG. 8B1. The display will show a dribble clock and may provide a countdown (e.g., red, yellow warning and green-to-go or 3-2-1-start) for starting the drill. The user 20 then has 30 seconds to dribble the ball as fast as possible and with as much force as possible. The feedback system, as illustrated by FIG. 8B2, visually displays how fast and with how much force the user 20 is dribbling the ball. The athlete can use one or two balls for this drill, such that the one ball is dribbled in the first zone 106 and the second ball is dribbled in the second zone 10A. Again, the controller can covert and store all of the data and provide feedback to the user 20 once the drill is over—instead of or in addition to during the drill. The feedback system can provide comparisons between the dominant hand versus the week hand, such as by a line graph depiction. The user can also select other pre-set training drills such as, for example, "25s," "FIG. 8," or "cross-over" drills as illustrate in FIG. 8C1. For "25s" the user will dribble one ball 25 times or two balls with each hand 25 times. The feedback system shows how fast this drill was completed and the dribble force and height. In the "figure-8 drill", the user can position one foot in zone 10A and another foot in zone 10B and dribble the ball in a "figure-8" pattern, in-and-out between his or her legs. For the cross-over drill, as shown by display of FIG. 8C1, the user 20 can use one ball and cross-dribble the ball between zones 10A and 10B. In this drill, since the right hand will be bouncing the ball on opposite zone 10A and the left hand bouncing the ball on the opposite zone 10B, the feedback system will read dribble speed and force of the right hand from sensors in zone 10A and will read the dribble speed and force of the left hand from sensors in zone 10B. Again, with any of the drills, the feedback system can provide speed, force, and/or height of the dribble to the user during the drill or after the drill is completed. The user has the option of saving the results, which can be stored by the controller and retrieved, by the progress option 22C. The user will have the option of deleting the results after the drill is completed or deleted the complete history in the progress option 22C. Once the progress option 22C is selected the user can see his or her progress of the characteristics by a listing of numerical values (e.g., a chart showing average characteristic per drill in one column and the date in another column) or in graphical depiction (e.g., vertical axis illustrating the average of the characteristics per drill and the horizontal axis showing the selected period of time). As can be seen in FIG. 8D2, the drill speed progress is depicted by a line graph for a selected period of 20 days, where an overall improvement can be seen in the 20 days.

The user can select the head-to-head menu option 22D, when two or more user compete against each other. In the head-to-head menu option 22D, the user can select time and drill and the display will provide the ranking of the players during the competition and after the competition. The ranking can be done based on just the ball speed, just the ball force, or the combination of both, based on the average. An example of the display is illustrated in FIGS. 7B and 7C.

One having ordinary skill in the art will readily understand that the invention as discussed above may be practiced with elements and configurations which are different than those which are disclosed or the pad can also be used for different uses. For example the dribble pad of the embodiments of the invention can also be used to measure a standing vertical of an athlete. Therefore, although the invention has been described based upon these preferred embodiments, it would be apparent to those of skill in the art that certain modifications, variations, and alternative constructions would be apparent, while remaining within the spirit and scope of the invention.

The invention claimed is:

1. A basketball dribbling pad, comprising:

a pad configured to allow a user to dribble at least one basketball on the pad;

a sensor integrated with the pad for detecting at least one dribbling characteristic; and a controller in communication with the sensor, the controller configured to covert the at least one dribbling characteristic into at least one dribbling feedback, wherein the pad comprises two dribbling zones, a first zone designated for dribbling of a first ball with a right hand and a second zone designated for dribbling a second ball with a left hand, such that the sensor of the first zone detects a first dribbling characteristic and the sensor of the second zone detects a second dribbling characteristic.

2. The basketball dribbling pad of claim 1, wherein the at least one dribbling characteristic is selected from a group consisting of dribble speed, dribble force, dribble height, or a combination of any of dribble speed, dribble force, and dribble height.

3. The basketball dribbling pad of claim 1, wherein the at least one dribbling feedback comprises a feedback selected from a group consisting of:

(a) a dribble speed for each dribble;

(b) a predicted average dribble speed for a duration of a selected drill;

(c) an actual average dribble speed for a duration of a selected drill; and (d) any combination of (a), (b), and (c).

4. The basketball dribbling pad of claim 3, wherein the controller is configured to store the dribbling feedback of more than one selected drill, and the controller is configured to provide a comparison of the dribbling feedback for selected drills performed.

5. The basketball dribbling pad of claim 4, wherein the comparison is shown on a monitor in a form of a line graph, such that the vertical axis includes the actual average dribble speed and the horizontal axis includes the selected drills performed.

6. The basketball dribbling pad of claim 1, wherein the at least one dribbling feedback comprises a feedback selected from a group consisting of:

(a) a unit force for each dribble;

(b) a predicted average unit force for a duration of a selected drill;

(c) an actual average unit force for a duration of a selected drill; and (d) any combination of (a), (b), and (c).

7. The basketball dribbling pad of claim 6, wherein the controller is configured to store the dribbling feedback of more than one selected drill, and the controller is configured to provide a comparison of the dribbling feedback for selected drills performed.

8. The basketball dribbling pad of claim 7, wherein the comparison is shown on a monitor in a form of a line graph, such that the vertical axis includes the actual average unit force and the horizontal axis includes the selected drills performed.

9. The basketball dribbling pad of claim 1, wherein the at least one dribbling feedback comprises a feedback selected from a group consisting of:

(a) a unit height for each dribble;

(b) a predicted average unit height for a duration of a selected drill;

(c) an actual average unit height for a duration of a selected drill; and (d) any combination of (a), (b), and (c).

10. The basketball dribbling pad of claim 9, wherein the controller is configured to store the dribbling feedback of more than one selected drill, and the controller is configured to provide a comparison of the dribbling feedback for selected drills performed.

11. The basketball dribbling pad of claim 10, wherein the comparison is shown on a monitor in a form of a line graph, such that the vertical axis includes the actual average unit height and the horizontal axis includes the selected drills performed.

12. The basketball dribbling pad of claim 1, wherein the controller provides live view of the least one dribbling feedback to the user or a coach on a monitor as the user is performing a dribbling drill.

13. The basketball dribbling pad of claim 12, wherein the height of the monitor is adjustable with respect to the pad to accommodate basketball players of different tallness.

14. The basketball dribbling pad of claim 12, wherein the monitor is adapted to be removably connected to the pad.

15. The basketball dribbling pad of claim 12, wherein the monitor is in wireless communication with the pad.

16. The basketball dribbling pad of claim 12, wherein the controller and monitor are selected from a group consisting of a computer, a smart phone, and a tablet.

17. The basketball dribbling pad of claim 1, wherein the pad comprising at least two dribbling zones such that each dribbling zone includes sensors for detecting dribbling characteristic associated with each respective zone.

18. The basketball dribbling pad of claim 1, wherein the sensor is configured to communicate with a phone or a tablet, such that the phone or tablet:

(a) is configured to provide designated drills for the user to perform;

(b) is configured to provide live view of the at least one dribbling feedback to the user or a coach while the user is dribbling at least one basketball on the pad;

(c) is configured to provide history of the at least one dribbling feedback performed by any number of users;

(d) is configured to provide comparison of the at least one dribbling feedback for drills performed by any number of users; or (e) any combination of (a)-(d).

* * * * *